US008453709B1

(12) United States Patent
Williams

(10) Patent No.: US 8,453,709 B1
(45) Date of Patent: Jun. 4, 2013

(54) JEWELRY WITH POSITIVE FINGERPRINT IMPRESSION

(76) Inventor: Brent Williams, Topsham, ME (US)

( * ) Notice: Subject to any disclaimer, the term of this patent is extended or adjusted under 35 U.S.C. 154(b) by 0 days.

(21) Appl. No.: 13/209,377

(22) Filed: Aug. 13, 2011

Related U.S. Application Data

(60) Provisional application No. 61/373,583, filed on Aug. 13, 2010.

(51) Int. Cl.
*B22C 7/02* (2006.01)
*B22C 9/04* (2006.01)

(52) U.S. Cl.
USPC ..... 164/35; 164/45

(58) Field of Classification Search
USPC ..... 164/35, 45; 29/896.412; 63/15
See application file for complete search history.

(56) References Cited

U.S. PATENT DOCUMENTS

| | | | | |
|---|---|---|---|---|
| 4,508,156 | A * | 4/1985 | Banks et al. | 164/35 |
| 4,993,472 | A * | 2/1991 | Culver | 164/35 |
| 5,906,234 | A * | 5/1999 | Mastrorio et al. | 164/45 |
| 6,299,818 | B1 * | 10/2001 | Hawkinson | 264/478 |
| 6,435,255 | B1 * | 8/2002 | Kaladjian | 164/35 |

* cited by examiner

*Primary Examiner* — Kevin P Kerns
(74) *Attorney, Agent, or Firm* — Patricia M. Mathers

(57) ABSTRACT

A method of providing a positive three-dimensional image of a textured object on metal jewelry, plates, or tags, etc. The textured object may be a finger, fingertip, or any object with a three-dimensional texture. A negative-impression mold is formed in a thermoplastic material, and a positive-impression model then obtained from the negative-impression mold. The positive-impression model is used in the lost-wax process to obtain a piece of metal jewelry having the positive, three-dimensional image of the textured object. The jewelry may be a ring, a pendant, a bracelet, etc., made of gold, silver, platinum, or other metal.

8 Claims, 1 Drawing Sheet

JEWELRY WITH POSITIVE FINGERPRINT IMPRESSION

BACKGROUND INFORMATION

1. Field of the Invention

The invention relates to jewelry. More particularly, the invention relates to a method of creating a positive image of a fingerprint on a piece of jewelry.

2. Discussion of the Prior Art

Fingerprint jewelry has high sentimental value, because the imprint of a loved one's finger tip on a piece of valued jewelry carries special meaning for the person wearing the jewelry. Currently, many pieces of fingerprint jewelry are produced by taking an ink imprint and then transferring the imprint onto metal, to acid etch or hand engrave the "friction ridges" as lines. CAD software may also be used to convert the ink imprint to a digital format, which is then used in conjunction with a computer-controlled laser-etching process, to etch lines on the metal. Any means that is based on an ink imprint, however, gives an inaccurate, two-dimensional impression of the fingerprint, rather than an actual three-dimensional representation of the fingerprint ridges.

Another known method is to warm a strip of jeweler's wax with water or a heat gun and to press the finger directly into the wax. It is hard, with this method, to obtain consistent high quality results for the final product for many different reasons, but primarily due to customer error. This method gives a negative image of the fingerprint, rather than an actual representation of the print. This soft wax cannot be varied in thickness, nor can it withstand much forming.

It is desirable to have a positive image or imprint of a fingerprint, because that corresponds to what we see, when we look at a fingerprint. In the past, it has been very difficult to obtain a good positive-impression wax model for use in applying fingerprint texturing to metal jewelry by the lost wax casting method. Typically, a modeling compound, such as PLAY-DOH, is used to obtain a negative-impression mold. This compound can then be used to make the positive-impression model, but the problem is, it is has to be used with jeweler's mold injection wax. This wax is very delicate and brittle and doesn't lend itself to forming around a mandrel to make a ring. Because the wax is brittle, the fingerprint texturing is frequently distorted or obliterated when working the wax to obtain the positive-impression model. Stiffer or harder wax is available, but cannot be used with the conventional modeling compound, because the negative-impression mold is not hard enough to transfer the fingerprint texturing to the stiffer wax.

What is needed, therefore, is a method of obtaining a positive representation of a fingerprint image on a piece of metal jewelry. What is further needed is such a method that is inexpensive and that reliably produces a fingerprint image of high quality.

BRIEF SUMMARY OF THE INVENTION

A fingerprint ring carries a particular significance for people receiving or exchanging rings, because each person has fingerprints that are unique. The invention is a method of creating a positive image of a fingerprint on a piece of jewelry, particularly on a ring, such as a wedding band. The method includes first obtaining negative-impression mold of the fingerprint, next obtaining a positive-impression model from the negative-impression mold, and then using the positive-impression model to cast the piece of jewelry.

A thermoplastic material is used to capture the negative-impression mold. A suitable thermoplastic material is one that can be softened by applying heat and that, when cooled, hardens and sets the impression. A positive-impression model is obtained from the negative-impression mold by pressing a firm wax into the negative-impression mold. The positive-impression model is cut to size and wrapped around a cylindrical mandrel to form a ring and is then sized. The model is then used in lost-wax casting to obtain a ring with the desired texturing.

The fingerprint image may be applied to the exterior or interior surface of the ring, or to a another type of jewelry, such as a pendant. For example, the image of the length of a finger, taken from the palm side and showing the friction ridges, may be shown as texture wrapped about the interior or exterior surface of the ring. One person's fingerprint may be applied to the interior surface and another person's to the exterior surface. Other types of fingerprint texturing on jewelry may include: two fingertips touching each other, as made famous in the film E.T. or the touch of just one fingertip. These are just a few examples of fingerprint imaging that may be applied to jewelry and they are not intended to be limiting in any way.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail. This invention should not, however, be construed as limited to the embodiments set forth herein; rather, they are provided so that this disclosure will be complete and will fully convey the scope of the invention to those skilled in the art.

Figure 1:
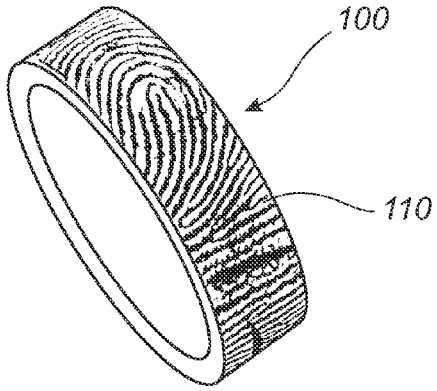
FIG. 1 is an illustration of a fingerprint ring with the image of the fingerprint cast onto the exterior surface of the ring.
Figure 2:
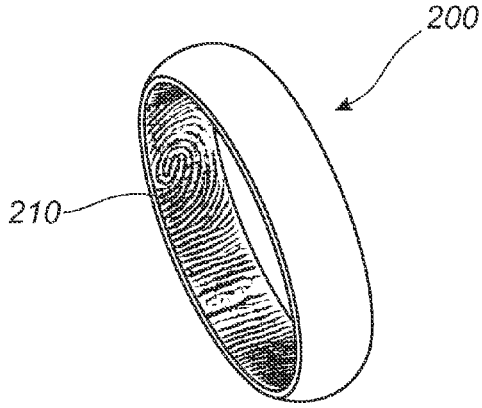
FIG. 2 is an illustration of a fingerprint ring, with the image of the fingerprint cast onto the interior surface of the ring.
Figure 3:
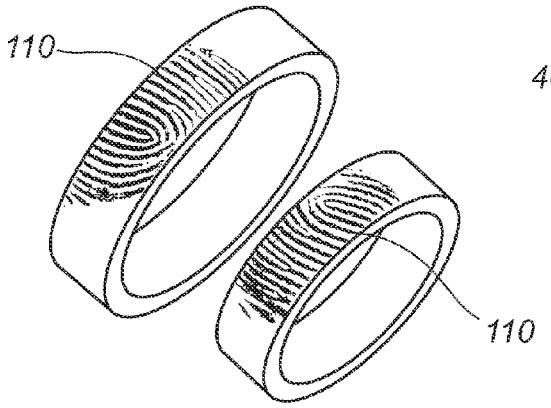
FIG. 3 shows fingerprint texturing taken from a fingertip on only a portion of the ring.
Figure 4:
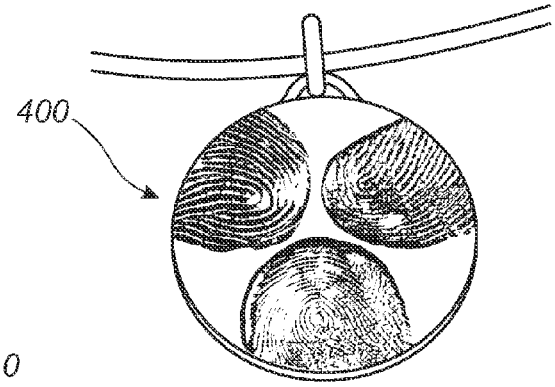
FIG. 4 shows a jewelry pendant with a plurality of fingertips.

The goal of the invention is to obtain a positive, three-dimensional image of an original finely textured object. The textured object may be a fingertip, a finger, or other body part or object that that has a three-dimensional shape or contour that is to be copied. FIGS. 1-4 illustrate articles that are made using the inventive method of the present application to obtain the texturing. FIGS. 1, 2, and 3 illustrate two embodiments of a fingerprint ring 100, 200, made according to the inventive method. FIG. 1 shows a wedding band with fingerprint texturing 110 applied to the exterior surface. FIG. 2 shows a wedding band, with the fingerprint texturing 110 applied to the interior surface. Although not shown, it is understood that the wedding bands may include a side band of smooth metal adjacent one or both edges of the fingerprint texturing, to accentuate the fingerprint texture. FIG. 3 shows jewelry with only the fingertip portion used as the fingerprint texturing 210. FIG. 4 shows a pendant 400, with fingerprint texturing from several fingertips. Not shown are other various embodiments of jewelry, such as bracelets, earrings, etc., but it is readily understood that the positive three-dimensional texturing obtained by the method according to the invention may also be applied to any type of jewelry or tags, plates, etc., made of gold, silver, platinum, or other metal.

The method of obtaining a positive three-dimensional textured image comprises three basic steps: 1) obtaining a negative-impression mold of a textured object; 2) obtaining a positive-impression model from the negative impression mold; and 3) casting the positive-impression model in the desired metal for the piece of jewelry. The result is a positive three-dimensional image of the original object.

One example of a suitable material for the negative-impression mold is a heat-sensitive, thermoplastic material that is commercially known as FRIENDLY PLASTIC, made by the American Art Clay Co. The thermoplastic material is cut into a piece large enough to obtain the desired fingerprint, typically into strips ½ inch wide and 3½ inches long. A foam material may be applied to the back of the strip of thermoplastic material. One purpose of the foam is to provide buoyancy to the thermoplastic material, so that it will float in water. The foam also serves to absorb pressure when the finger is applied to the thermoplastic material. This enhances the precision of the imprint, because it reduces the likelihood of creating a flat spot in the imprint or otherwise obliterating details of the imprint, when excessive pressure is applied to the material. For example, without the foam, one can press down on the material with sufficient force to obliterate the ridge formations in the fingerprint and, instead, create a flat spot or area. The foam absorbs the excessive force, thereby preserving a good three-dimensional imprint of the finger. A suitable foam is the adhesive-backed foam from Darice, Inc., of Strongsville, Ohio, that is known commercially under the trademark FOAMIES.

The piece of thermoplastic material thus prepared is sent to the customer with instructions on how to capture a fingerprint imprint. The material is a thermoplastic, so it is first warmed to a certain temperature to achieve its plastic state, so as to be impressionable. If the FRIENDLY PLASTIC material mentioned above is used, the instructions are to pour one cup of boiling water into a glass container that is at room temperature. When the temperature of the water has cooled to approximately 150 degrees F., the thermoplastic material is placed into the glass container, where it floats on the top and is warmed by the water. Of course, depending on the material used, the time may vary, but a typical period of time is about 30 seconds. The warmed thermoplastic material is then removed from the container and quickly placed on a flat surface, foam side down. The person then firmly presses the length of his or her finger or fingertip, depending on the desired image, into the thermoplastic material. Firm pressure is evenly applied downward into the impression material for about 30 seconds. The softened thermoplastic material flows into the spaces between the fingerprint ridges, thereby accurately capturing the texture of the fingerprint. At this point, the thermoplastic material sticks to the finger. Running cold water over the thermoplastic material on the finger for about 30 seconds causes the thermoplastic material to set, transforming the material into the negative-impression mold, which may now be peeled from the finger. The result is a perfectly captured impression of the finger or fingertip, with all the friction ridges and other features of texture, on a material that is set, i.e., fixed with some firmness and stiffness. This relatively hard mold can be used like a stamp, for stamping out positive-impression models from softened wax. The negative-impression mold according to the invention is also durable and, thus, multiple models can be made from it.

The next step is to obtain the positive-impression model. A relatively hard, stiff, yet pliable, wax is needed for this step. The Kindt-Collins Company, LLC, of Cleveland, Ohio, produces a variety of waxes for industrial and specialty uses, including a green colored sheet wax, that is a slightly firm but pliable wax and comes in various thicknesses. This stiff green-colored wax, is very useful for making a positive-impression model that is adapted to the desired thickness of the ring. A piece of this green-colored wax that is somewhat larger than the piece of jewelry that is to be made is first warmed, so that it is readily impressionable, and is then placed on top of the negative-impression mold. The wax is pressed into the negative-impression mold manually, either with a finger or thumb or using a brayer roller. In some cases, the fingerprint texturing on the negative-impression mold may be faint. The durability of the thermoplastic material allows the green-colored wax to be pressed into the negative-impression mold with significant force, to ensure that the details are transferred to the positive-impression model. This firmness of the negative-impression mold also ensures that the fingerprint texturing is not obliterated in this process, as would be the case with a mold made of moldable material. The green-colored wax has also proven to be resilient when working its surface around a mandrel to form a ring with exterior fingerprint texturing. A softer wax tends to stretch too much, thereby distorting the fingerprint texturing. This green-colored wax can be softened in warm water. The conventional jeweler's carving wax, on the other hand, cannot be softened in this manner, and thus, it is unsuitable for obtaining fingerprint texturing directly from the finger.

The positive-impression model may be trimmed to obtain a rectangle having the appropriate length and width to form the desired piece of jewelry or pendant. To form a ring, a cylindrical, i.e., not a tapered, mandrel is covered with the foam material described above and the positive-impression model then wrapped around it. Here, too, the foam material serves to absorb excessive pressure, to prevent the hard smooth metal of the mandrel from obliterating details of the positive-impression model.

Alternatively, the negative-impression mold along with the wax may be placed on a base having a smooth, flat surface, for example, a sheet of glass, synthetic glass, such as PLEXIGLAS, or other suitable material. The base along with the negative-impression mold and the wax is placed between the platens of a non-heated vulcanizer. The two platens are squeezed together at a pressure that is sufficient to force the wax into the negative-impression mold, in order to obtain a positive-impression model that is a perfect positive impression of the fingerprint.

The positive-impression model, formed about the mandrel or with the vulcanizer method, is then transferred to a jeweler's wax-modeling mandrel, again, a straight-sided cylindrical mandrel, and the ring completed to the correct size. A very straight cut is made on the wax to cut the positive-impression model to the correct length for the desired ring size. Heat is used to fuse the ends of the wax model together. Additional wax may be used to clean up the seam area, to achieve the appearance of a seamless ring. This is now the wax master model, which is then used in lost wax casting to obtain a ring with fingerprint texturing, either with exterior fingerprint texturing or interior fingerprint texturing.

The method according to the invention was described above in the context of obtaining a fingerprint ring, because there is great demand for that type of jewelry. As mentioned above, it is, of course, possible to use the positive-impression model to form other types of jewelry, such as a pendant, a brooch, a bracelet, etc.

It is understood that the embodiments described herein are merely illustrative of the present invention. Variations in the construction of the fingerprint texturing may be contemplated by one skilled in the art without limiting the intended scope of the invention herein disclosed and as defined by the following claims.

What is claimed is:

1. A method of obtaining a positive three-dimensional image of a textured object on a piece of metal, the method comprising the steps of:

a) providing a thermoplastic material with a buoyancy material applied to the thermoplastic material;

b) obtaining a re-usable negative-impression mold of a textured object, the negative-impression mold being made of the thermoplastic material;

c) obtaining a positive-impression model by pressing wax into the negative-impression mold; and d) using the positive-impression model in a lost-wax casting process to obtain a positive three-dimensional image of the textured object.

2. The method of claim 1, further comprising the step of:

e) providing instructions for warming the thermoplastic material to a temperature at which the thermoplastic material becomes plastic, impressing the textured object onto the thermoplastic material to obtain the negative-impression mold, and cooling the thermoplastic material so that the negative-impression mold sets.

3. The method of claim 1, wherein the buoyancy material is a foam material applied as a backing to the thermoplastic material.

4. The method of claim 3, wherein the foam backing is applied to the thermoplastic material to serve as a cushion to prevent the texture of the textured object from becoming obliterated when obtaining the negative-impression mold.

5. The method of claim 1, wherein step c) includes the step of:

c1) working the positive-impression model to obtain a desired shape and size.

6. The method of claim 5, wherein step c1) includes further shaping the positive-impression model on a mandrel to form a ring.

7. The method of claim 6, wherein the textured object is a fingerprint and step c) includes the step of shaping the ring with the positive-impression model on the inner surface of the ring.

8. The method of claim 6, wherein the textured object is a fingerprint and step c1) includes the step of shaping the ring with the positive-impression model on the outer surface of the ring.

* * * * *